US007419151B2

(12) United States Patent
Kaneko

(10) Patent No.: US 7,419,151 B2
(45) Date of Patent: Sep. 2, 2008

(54) SHEET PROCESSING APPARATUS

(75) Inventor: Tamaki Kaneko, Fujisawa (JP)

(73) Assignee: Kaneko Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/826,958

(22) Filed: Apr. 15, 2004

(65) Prior Publication Data

US 2004/0262832 A1 Dec. 30, 2004

(30) Foreign Application Priority Data

May 21, 2003 (JP) ..... 2003-142861

(51) Int. Cl.
*B65H 37/04* (2006.01)

(52) U.S. Cl. ..... 270/58.08; 270/58.11; 270/58.14

(58) Field of Classification Search ..... 270/58.08, 270/58.11, 58.14; 399/410
See application file for complete search history.

(56) References Cited

U.S. PATENT DOCUMENTS 5,112,034 A * 5/1992 Uto et al. ..... 270/58.12
5,449,157 A * 9/1995 Kawano et al. ..... 270/58.11
5,762,328 A * 6/1998 Yamada et al. ..... 270/58.08
6,375,180 B1 * 4/2002 Kawano et al. ..... 270/58.09
6,491,492 B1 * 12/2002 Cook ..... 414/789.9
6,517,065 B2 * 2/2003 Miyake et al. ..... 270/58.09
6,577,845 B2 * 6/2003 Stevens ..... 399/408
2002/0014733 A1 * 2/2002 Miyake et al. ..... 270/58.08
2004/0175217 A1 * 9/2004 Nakamura et al. ..... 399/407

* cited by examiner

*Primary Examiner*—Gene O. Crawford
*Assistant Examiner*—Leslie Nicholson, III
(74) *Attorney, Agent, or Firm*—Cooper & Dunham LLP

(57) ABSTRACT

A sheet processing apparatus includes a first roller pair conveying a sheet received from an external apparatus, a second roller pair conveying the sheet conveyed from the first roller pair, a jogging tray configured to receive the sheet conveyed from the second roller pair and jog the received sheet, and a binding device configured to bind a stack of sheets received and jogged by the jogging tray. The second roller pair can be driven to rotate such that sheets received from the external device and conveyed by the first roller pair one after another are pinched by the second roller pair one after another while being overlapped one upon another with leading edges thereof shifted stepwise one after another and are held by the second roller pair to be further conveyed to the jogging tray.

9 Claims, 12 Drawing Sheets

SHEET PROCESSING APPARATUS

The present application claims priority and contains subject matter related to Japanese Patent Application No. 2003-142861 filed in the Japanese Patent Office on May 21, 2003 and the entire contents of which are hereby incorporated by reference.

BACKGROUND OF THE INVENTION

1. Field of the Invention

The present invention relates to a sheet processing apparatus that receives sheets conveyed from an external apparatus one after another and binds the received sheets.

2. Discussion of the Background

A sheet processing apparatus connected with an image forming apparatus such as a copier and a printer receives sheets conveyed from the image forming apparatus one after another, stacks and jogs the received sheets, and then performs a binding process such as stapling and punching to the sheets. Generally, while the sheet processing apparatus is jogging a received set of sheets to be bound and performing the binding process to the sheets, the image forming apparatus stops forming images on next set of sheets and waits for the binding process to be completed at the sheet processing apparatus.

A known sheet processing apparatus includes a waiting part in which a certain number of sheets received from an image forming apparatus are temporarily held, so that the image forming apparatus does not need to stop forming images when the sheet processing apparatus is jogging and binding a previously received set of sheets. However, when the image forming speed of the image forming apparatus is relatively high, due to insufficient capacity of the waiting part, it occurs that the image forming apparatus is required to stop forming images when the sheet processing apparatus is jogging and binding a previously received set of sheets.

SUMMARY OF THE INVENTION

The present invention has been made in view of the above-discussed and other problems and addresses the above-discussed and other problems.

Preferred embodiments of the present invention provide a novel sheet processing apparatus in which sheets received from an image forming apparatus one after another when a previously received set of sheets are being jogged and bound are held to be further conveyed to a jogging tray and the held sheets are conveyed to the jogging tray after the previously received set of sheets have been completed to be bound so that the image forming apparatus does not need to stop forming images and subsequent sets of sheets can be efficiently bound.

According to a preferred embodiment of the present invention, a sheet processing apparatus includes a first roller pair conveying a sheet received from an external apparatus, a second roller pair conveying the sheet conveyed from the first roller pair, a jogging tray configured to receive the sheet conveyed from the second roller pair and jog the received sheet, and a binding device configured to bind a stack of sheets received and jogged by the jogging tray. The second roller pair can be driven to rotate such that sheets received from the external apparatus and conveyed by the first roller pair one after another are pinched by the second roller pair one after another while being overlapped one upon another with leading edges thereof shifted stepwise one after another and are held by the second roller pair to be further conveyed to the jogging tray.

In the above-described sheet processing apparatus, the second roller pair may be driven to intermittently rotate or to rotate at a circumferential speed that is slower than that of the first roller pair so that sheets conveyed by the first roller pair one after another are pinched by the second roller pair one after another while being overlapped one upon another with leading edges thereof shifted stepwise one after another and are held by the second roller pair to be further conveyed to the jogging tray.

Further, in the above-described sheet processing apparatus, the sheet received from the external device may be conveyed from the first roller pair to the second roller pair through a conveying path between the first roller pair and the second roller pair and an open area may be provided to the conveying path so that when the second roller pair is driven to rotate such that sheets conveyed by the first roller pair one after another are pinched by the second roller pair one after another while being overlapped one upon another with leading edges thereof shifted stepwise one after another, a trailing edge of each of the sheets conveyed by the first roller pair one after another can retreat from the conveying path to the open area after the sheet has been pinched by the second roller pair.

The sheet processing apparatus described immediately above may further include a discharging device configured to cause the trailing edge of each of the sheets conveyed by the first roller pair one after another to retreat from the conveying path to the open area after the sheet has been pinched by the second roller pair.

The sheet processing apparatus described immediately above may alternatively further include a bulging device arranged at the conveying path and configured to cause, when the second roller pair is driven to rotate such that sheets conveyed by the first roller pair one after another are pinched by the second roller pair one after another while being overlapped one upon another with leading edges thereof shifted stepwise one after another, each of the sheets conveyed by the first roller pair one after another to bulge toward the open area when pinched by the second roller pair so that a trailing edge thereof retreats from the conveying path to be discharged into the open area.

The sheet processing apparatus described immediately above may alternatively further include a moving guide device configured to guide the sheet being conveyed by the first roller pair to be conveyed through the conveying path and to move to provide the open area to the conveying path when the second roller pair is driven to rotate such that sheets conveyed by the first roller pair one after another are pinched by the second roller pair one after another while being overlapped one upon another with leading edges thereof shifted stepwise one after another so that each of the sheets conveyed by the first roller pair and pinched by the second roller pair bulges toward the open area and when a trailing edge thereof has been released from the first roller pair, the trailing edge thereof retreats from the conveying path to be discharged into the open area.

In each of the above-described sheet processing apparatuses, when the binding device is performing a binding operation, the second roller pair may be driven to rotate such that sheets conveyed by the first roller pair one after another are pinched by the second roller pair one after another while being overlapped one upon another with leading edges thereof shifted stepwise one after another and are held by the second roller pair to be further conveyed to the jogging tray. The sheets held by the second roller pair are discharged onto the jogging tray after completion of the binding operation.

Further, each of the above-described sheet processing apparatuses may further include a discharging device discharging the stack of sheets bound by the binding device from the jogging tray. In this case, when the stack of sheets bound by the binding device has not been discharged from the jogging tray in a predetermined period of time or when the jogging tray has not returned to a reference position in a predetermined period of time, the second roller pair is driven to rotate such that sheets conveyed by the first roller pair one after another are pinched by the second roller pair one after another while being overlapped one upon another with leading edges thereof shifted stepwise one after another and are held by the second roller pair to be further conveyed to the jogging tray.

In each of the above-described sheet processing apparatuses, the external device may be an image forming apparatus.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1:
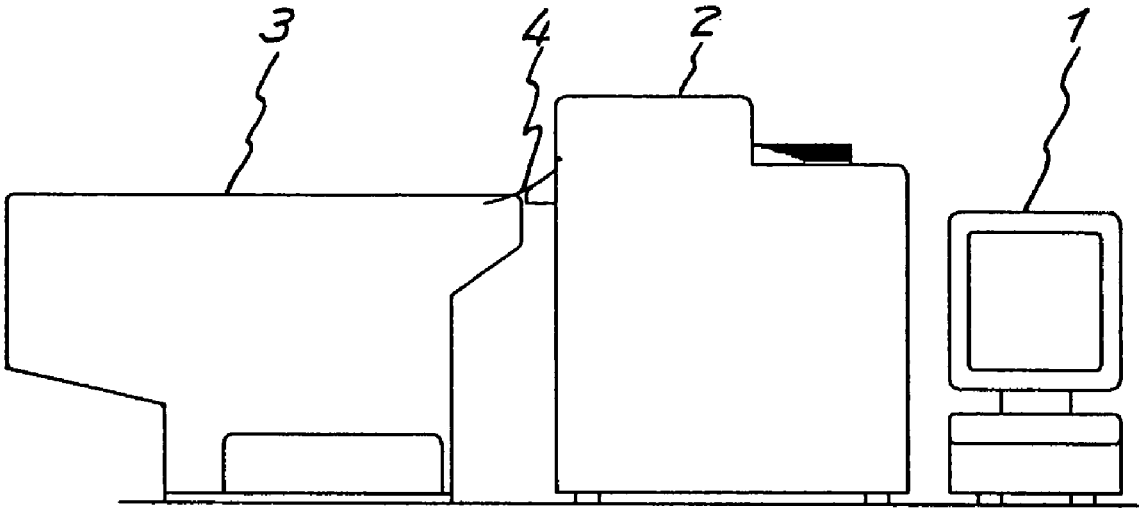
FIG. 1 is a diagram of a system in which a sheet processing apparatus of the present invention is connected with an image forming apparatus controlled by an image formation controller.

Referring now to the drawings, wherein like reference numerals designate identical or corresponding parts throughout the several views, preferred embodiments of the present invention are described.

FIG. 1 illustrates a system in which a sheet processing apparatus according to a preferred embodiment of the present invention is connected with an image forming apparatus controlled by an image formation controller.

In FIG. 1, a PC 1 as the image formation controller includes a display, a keyboard, a scanner, etc., and generates an image, reads an image with the scanner, receives an image sent from an external device, etc., and stores theses images in a storage device. The PC 1 also performs editing and pagination of these images. A printer 2 as an example of the image forming apparatus includes a sheet feeding device, and forms an image on a sheet conveyed from the sheet feeding device according to image data sent from the PC 1. Generally, the printer 2 forms the image using an ink jet process or electrophotography. The printer 2 feeds out the sheet from the sheet feeding device, and forms the image on the sheet according to an instruction from the PC 1, and the sheet discharged from the printer 2 is received by a sheet processing apparatus 3 of the present invention as a sheet 4.

Figure 2:
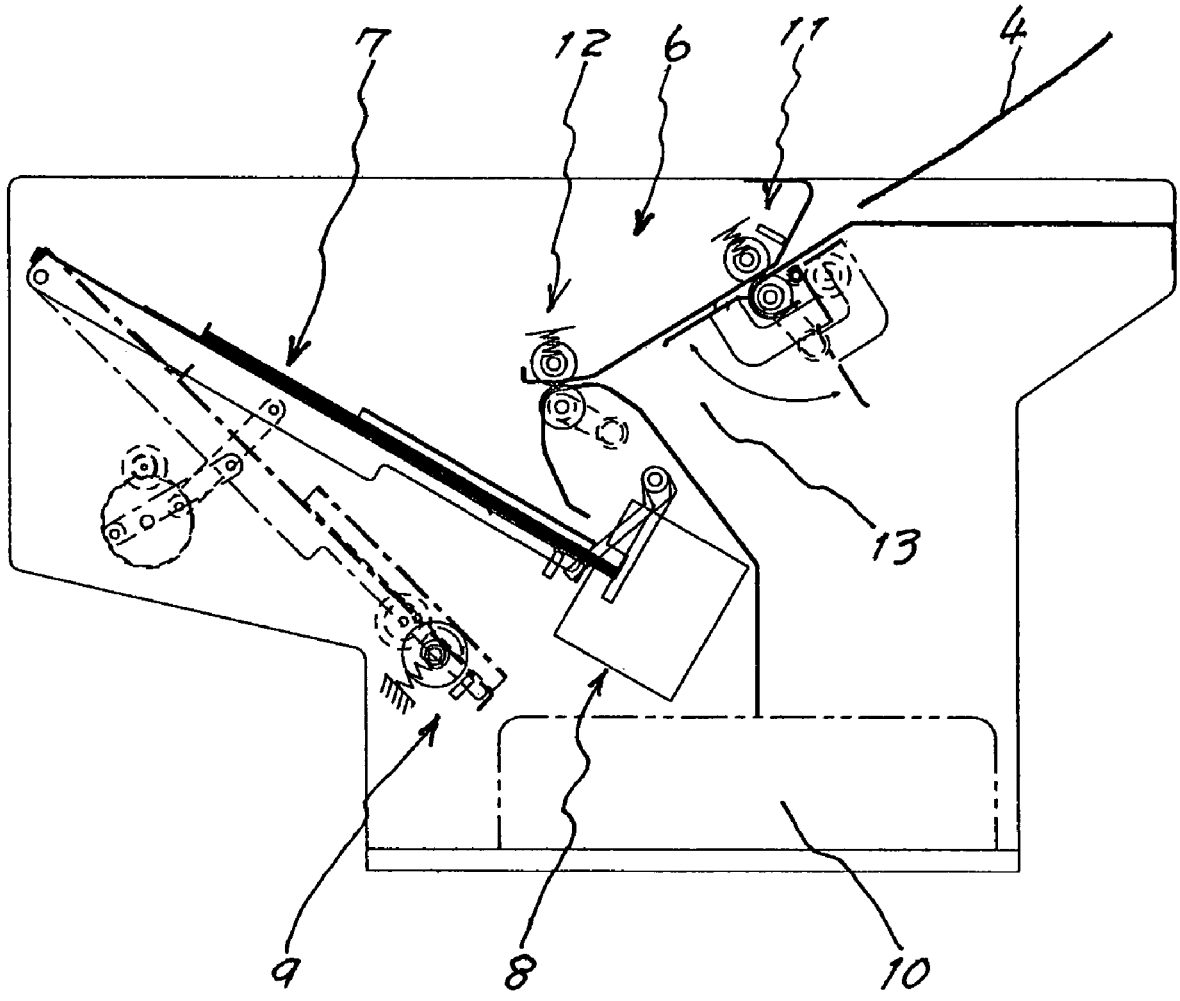
FIG. 2 is a cross section illustrating an exemplary construction of the sheet processing apparatus.

FIG. 2 illustrates an exemplary construction of the sheet processing apparatus 3. The sheet processing apparatus 3 includes a sheet waiting part 6, a jogging part 7, a binding part 8, and a discharging part 9. The sheet waiting part 6 includes a receiving part 11 and a waiting part 12.

Figure 3:
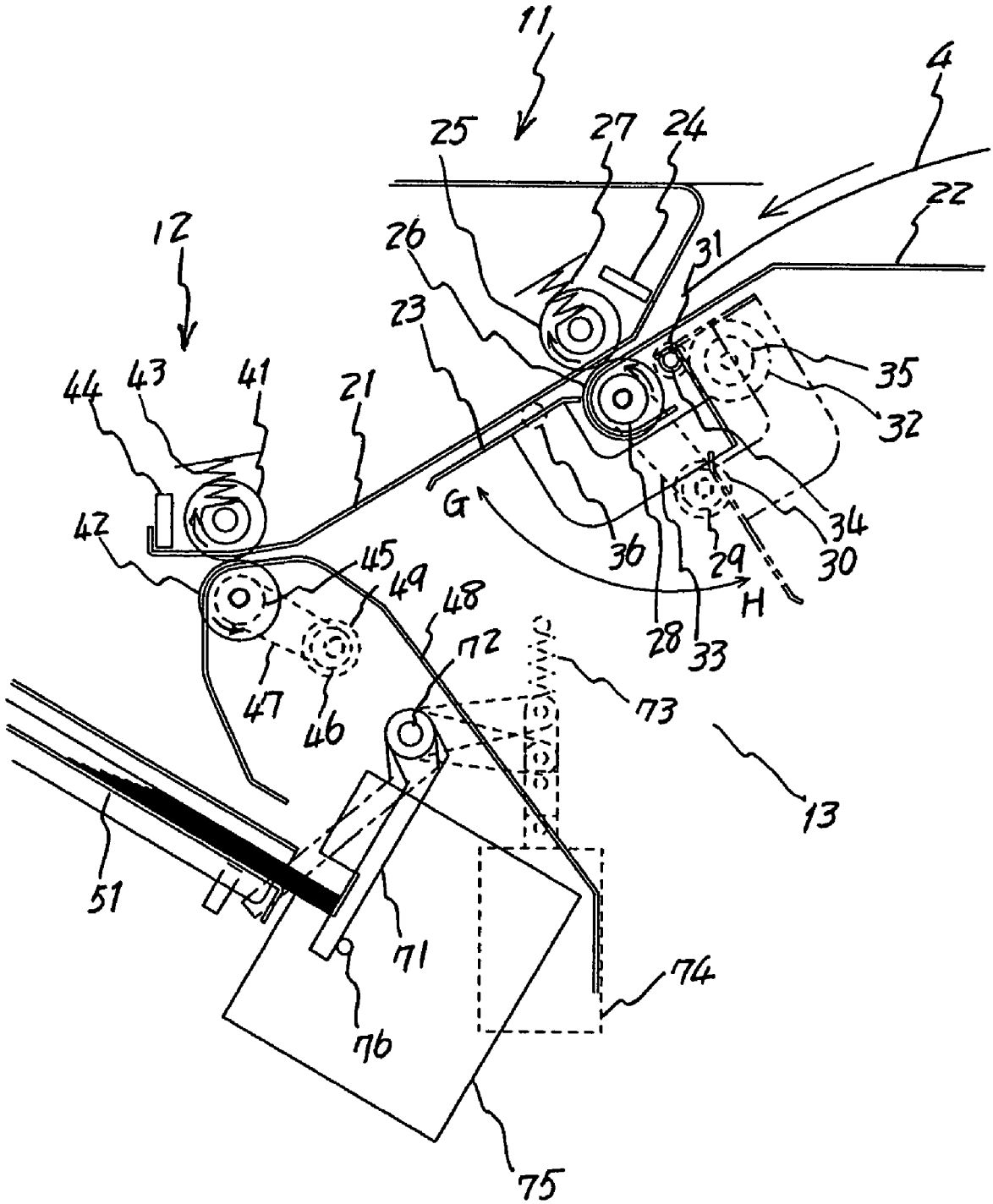
FIG. 3 is a cross section illustrating an exemplary construction of a sheet waiting part of the sheet processing apparatus.

FIG. 3 illustrates an exemplary construction of the sheet waiting part 6 of the sheet processing apparatus 3. The receiving part 11 includes an upper guide plate 21 and a lower guide plate 22 that guide the sheet 4 when the sheet 4 is received, and a sensor 24 detecting the received sheet 4. The receiving part 11 further includes a roller 25 and a roller 26 serving as a first roller pair of the present invention that conveys the received sheet 4. The roller 25 is placed on the roller 26 and is pressed by a spring 27 supported with bearings by side plates of a main body of the apparatus 3. The roller 26 is integrated with a pulley 28 and is rotated by rotation of the pulley 28. The pulley 28 is rotated via a belt 33 by rotation of a pulley 29 integrally mounted to an axis of a motor 30. The roller 25 and the roller 26 rotate in directions indicated by arrows in figure, respectively, at a circumferential speed V corresponding to the speed at which the sheet 4 is conveyed from the printer 2.

A moving guide plate 23 is usually located at a reference position "G", and is moved to an "H" position with rotation of a motor 35 under control of a control device (not shown) so that an open area 13 is formed below the upper guide plate 21 at the downstream side of the roller 26 in the direction in which the sheet 4 is conveyed. A moving guide plate sensor 36 detects the moving guide plate 23 when the moving guide plate 23 is located at the reference position G. The moving guide plate 23 is rotated around an axis 34 to the reference position G and the H position with rotation of the motor 35. An gear 31 mounted to the axis 34 is engaged with a gear 32, which is integrated with an axis of the motor 35 fixed to the side plates of the main body of the apparatus 3, and thereby the moving guide plate 23 is moved to the reference position G and the H position with rotation of the motor 35.

The waiting part 12 includes a sensor 44 attached to the upper guide plate 21, a roller 42 located inside of a cover 48 and supported with bearings by the side plates of the main body of the apparatus 3, and a roller 41 placed on the roller 42 and pressed by a spring 43. The roller 42 and the roller 41 serve as a second roller pair of the present invention. Gears are integrally mounted to respective axes of the roller 42 and the roller 41. A pulley 46 integrated with an axis of a motor 49 mounted to the side plates of the main body of the apparatus 3 is rotated with rotation of the motor 49, a pulley 45 is thereby rotated via a belt 47, and the roller 42 integrated with the pulley 45 and the roller 41 are rotated.

The roller 25 and the roller 26 as the first roller pair always rotate at the circumferential speed V corresponding to the speed at which a sheet 4 is conveyed from the printer 2. The roller 41 and the roller 42 as the second roller pair, which are rotated by the motor 49, are controlled by the control device to rotate at the same circumferential speed as that of the roller 25 and the roller 26, i.e., at the circumferential speed V, usually, and to perform a standby operation when the binding part 8 is performing a binding operation and when a trouble such as sheet jamming has occurred at the binding part 8 and/or the discharging part 9. For example, the roller 41 and the roller 42 as the second roller pair may be rotated at a circumferential speed decreased to about one twentieth of the circumferential speed V of the roller 25 and the roller 26, and thereby sheets 4 received from the printer 2 and conveyed by the roller 25 and the roller 26 one after another are pinched by the roller 41 and the roller 42 one after another while being overlapped one upon another with respective leading edges thereof shifted stepwise one after another and are held by the roller 41 and the roller 42 to be further conveyed to the jogging part 7. At this time, respective trailing edges of the sheets 4 held by the roller 41 and the roller 42 are discharged to an open area 13 formed below the upper guide plate 21 by moving the moving guide plate 23 to the H position as described later more in detail. In this case, because the circumferential speed of the roller 41 and the roller 42 as the second roller pair is decreased to about one twentieth of that of the roller 25 and the roller 26 as the first roller pair, about 20 sheets 4 can be held by the roller 41 and the roller 42. The ratio of decreasing the circumferential speed of the roller 41 and the roller 42 relative to that of the roller 25 and the roller 26 can be determined between about one half and about one thirtieth of the speed of the roller 25 and the roller 26 based on the number of sheets 4 to be held by the roller 41 and the roller 42. Further, the roller 41 and the roller 42 may be intermittently stopped after conveying each sheet 4 by a predetermined distance at the circumferential speed V or a decreased speed.

Figure 4:
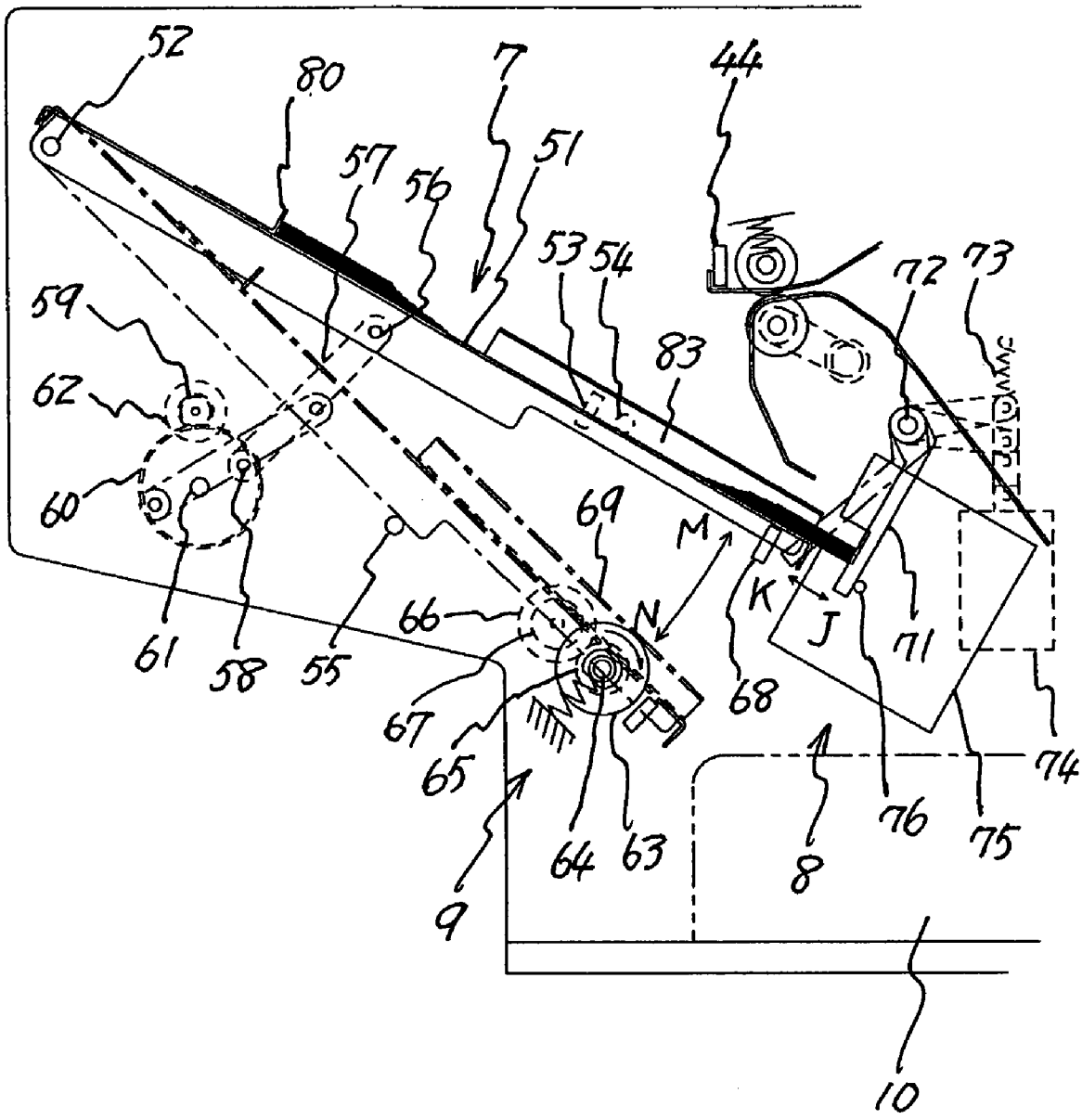
FIG. 4 is a cross section illustrating an exemplary construction of a jogging part, a binding part and a discharging part of the sheet processing apparatus.
Figure 5:
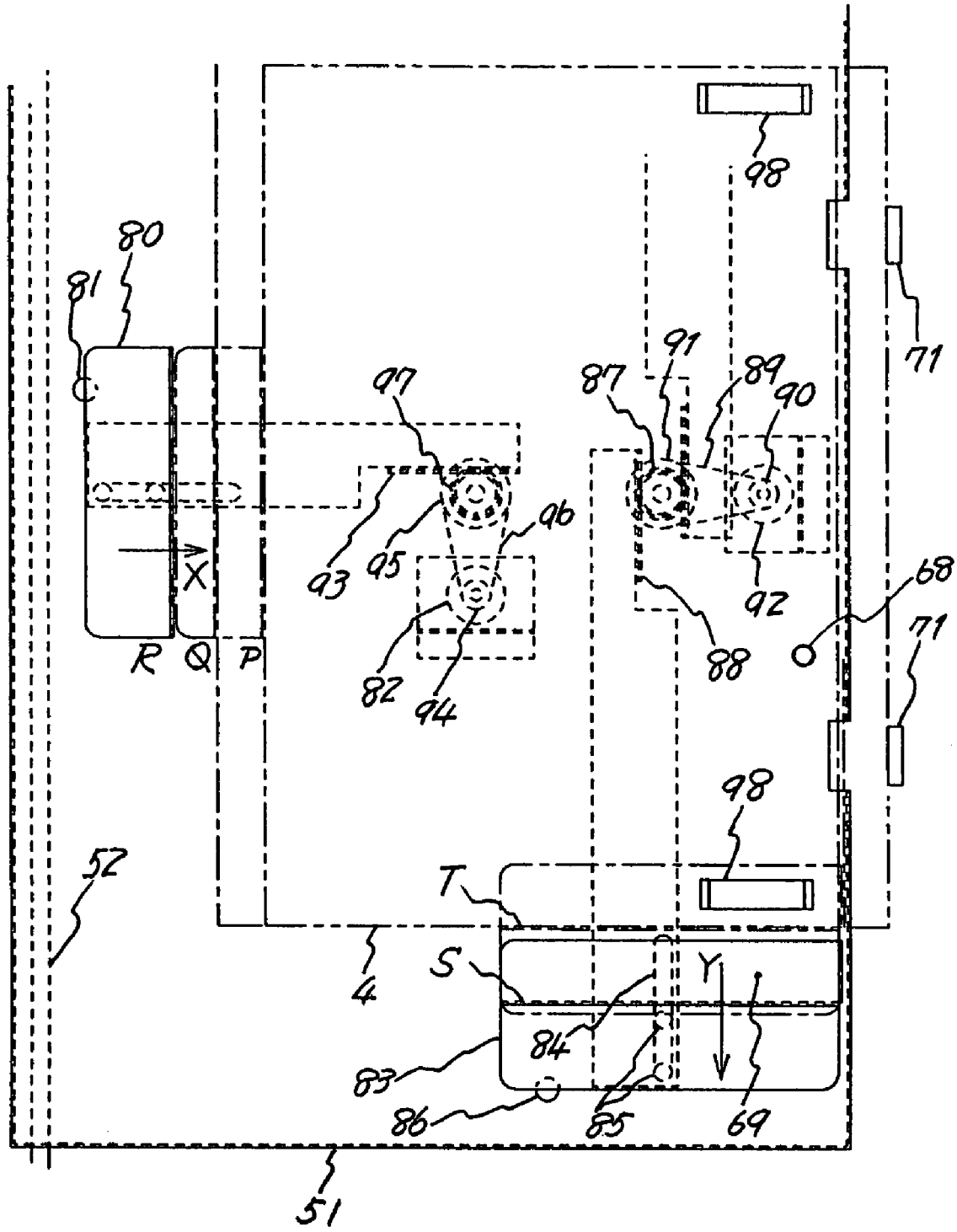
FIG. 5 is a plan view of a part of a tray of the sheet processing apparatus for explaining the jogging part.

FIG. 4 illustrates an exemplary construction of the jogging part 7, the binding part 8 and the discharging part 9, and FIG. 5 illustrates a part of a tray 51 of the jogging part 7. The tray 51 freely swings around an axis 52 fixed to the side plates of the main body of the apparatus 3, and an upper side stopper 54 and a lower side stopper 55 set swinging positions of the tray 51. A link 57, which is connected with a support point 56 mounted to a side plate of the tray 51, is connected with a support point 58 mounted to a gear 60 fixed to an axis 61 supported with bearings by the side plates of the main body, and a gear 59, which is integrated with an axis of a motor 62 mounted to the side plates of the main body, engages with the gear 60, and the tray 51 is driven to move to an uppermost position "M" and a lowermost position "N" where the tray 51 is illustrated by a dashed line with rotation of the motor 62. A sensor 53 detects the tray 51 at the M position.

In the discharging part 9, a discharging roller 63 is rotated with a gear 66 and a gear 65 engaging with the gear 66. The gear 66 is fixed to an axis of a motor 67 mounted to the side plates of the main body.

When the tray 51 has moved to the lowermost position N indicated by the dashed line in FIG. 4, the discharging roller 63 is located at the position corresponding to roller holes 98 of the tray 51 (see FIG. 5), and parts of the discharging roller 63 come out through the roller holes 98 to the upper surface of the tray 51. At this time, if a side guide plate 83 is located at a "T" position of aligning sheets 4, a stack of sheets 4 on the tray 51 are sandwiched by an upper plate 69 of the side guide plate 83 and the discharging roller 63. The discharging roller 63 is configured such that the position of a rotation center thereof relative to the stack of sheets 4 on the tray 51 can be moved. The discharging roller 63 is pressed by a spring (not illustrated) to a predetermined position, so that when discharging the stack of sheets 4 on the tray 51, regardless of the thickness of the stack of sheets 4, the stack of sheets 4 is sandwiched by the upper plate 69 of the side guide plate 83 and the discharging roller 63 by a predetermined pressure, and thereby the stack of sheets 4 can be reliably discharged to a discharging outlet 10.

The binding part 8 illustrated in FIG. 4 includes a stapler 75 having an opening part in which leading edges of a stack of sheets 4 are put in and aligned, a stopper 71 which positions the leading edges of the stack of sheets 4, and an axis 72 serving as a rotation center of the stopper 71. The stopper 71 is usually caused to be located at a "J" position for positioning leading edges of the stack of sheets 4 with a spring 73 and a positioning pin 76, and is swung to a "K" position by a solenoid 74.

FIG. 5 illustrates the tray 51 viewed from the above. An end guide plate 80 and the side guide plate 83 are arranged on the upper surface of the tray 51. The end guide plate 80 includes a motor 82, a pulley 94, a pulley 95, a belt 96, and a pinion 97, which are provided to the backside surface of the tray 51, and a rack 93 mounted to the backside surface of the tray 51 integrally with the end guide plate 80, and is moved to a binding position "P" to push a stack of sheets 4 on the tray 51 to be positioned by the stopper 71 at the J position with rotation of the motor 82. A sensor 81 is provided at a reference position "R", that is the outermost position to which the end guide plate 80 can move, and the end guide plate 80 is controlled by the control device to move to the reference position R, the binding position P, and a discharging position "Q", to which the stack of sheets 4 is returned from the opening part of the stapler 75 after having been stapled by the stapler 75.

In this example, though not illustrated in FIG. 5, the side guide plate 83 is arranged at each side part of the tray 51 symmetrically with respect to the center of a sheet 4 in the direction in which the sheet 4 is received, and a stack of sheets 4 on the tray 51 are aligned with the center thereof in the direction in which the sheets 4 are received located at the widthwise center of the tray 51 by being pushed at both side edges thereof by the side guide plate 83. However, the side guide plate 83 at one side part of the tray 51 may be fixed and the side guide plate 83 at the other side part of the tray 51 may move. In this case, the stack of sheets 4 on the tray 51 are aligned by being pushed against the fixed side guide plate 83 by the moving side guide plate 83. A pin 85 of the side guide plate 83 engages with a guide hole 84 provided in the tray 51 and a rack plate 88 fixed to the backside surface of the side guide plate 83 is moved by a pinion 87 which is driven by a motor 92, so that the side guide plate 83 is moved from a reference position "S" to the T position of aligning sheets 4. A sensor 86 is arranged to detect the side guide plate 83 at the reference positions, and the side guide plate 83 is moved from the reference position S to the T position under control of the control device.

Figure 6A:
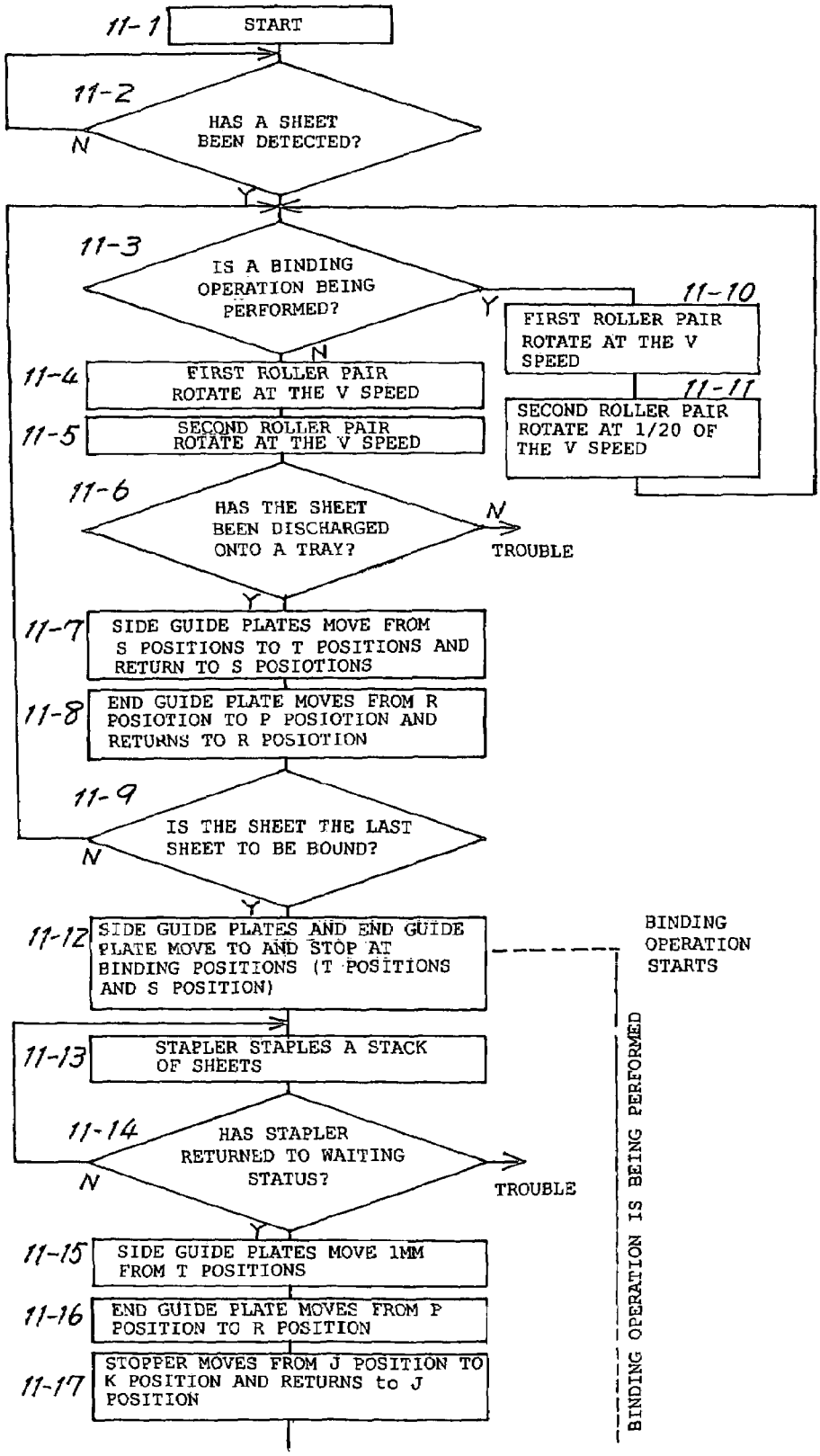
FIG. 6A and FIG. 6B are flowcharts of an exemplary operation of the sheet processing apparatus.
Figure 6B:
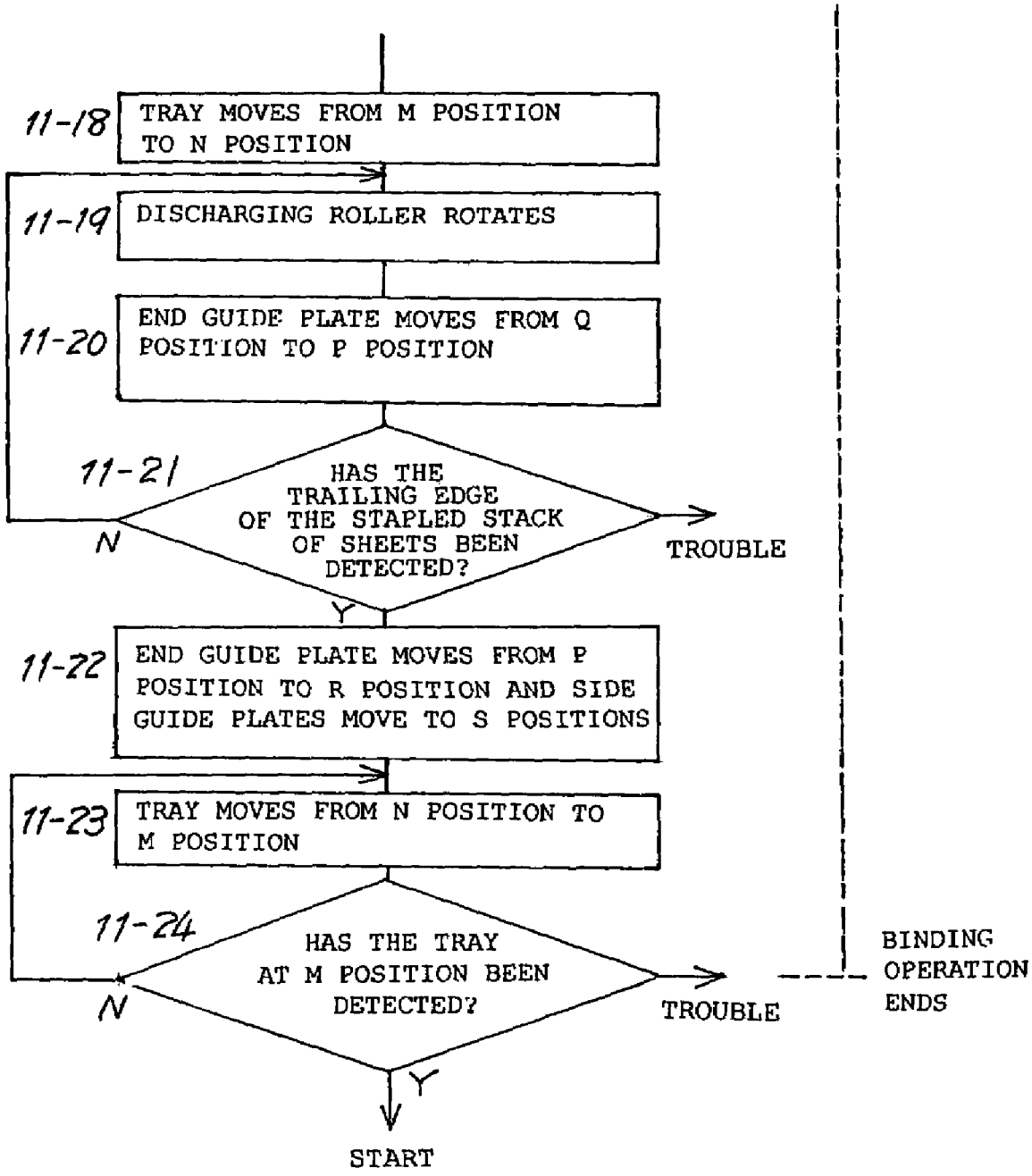

Now, the operation of the sheet processing apparatus 3 will be described referring to FIG. 6A and FIG. 6B.

When the power of the sheet processing apparatus 3 has been turned on (S11-1), the moving guide plate 23 is moved to the G position, the tray 51 of the binding part 7 is moved to the uppermost position M, and then the motor 62 stops. The stopper 71 moves to the J position when the solenoid 74 is turned off, and the end guide plate 80 of the tray 51 moves to the R position with rotation of the motor 82. The side guide plate 83 is moved to the S position with rotation of the motor 92. The stapler 75 is put in the standby status.

When the first sheet 4 of a stack of sheets 4 to be bound has been conveyed from the printer 2 to the receiving part 11 of the sheet waiting part 6 and detected by the sensor 24 (Y in S11-2), the control device determines if a binding operation is being performed at the binding part 8 (S11-3). When it has been determined as that the binding operation is not being performed at the binding part 8 (N in S11-3), the motor 30 and the motor 49 start to rotate. In this case, the roller 25 and the roller 26 as the first roller pair and the roller 41 and the roller 42 as the second roller pair rotate at the circumferential speed V corresponding to the speed at which the sheet 4 is conveyed from the printer 2 (S11-4 and S11-5). The sheet 4 is conveyed by the pair of the roller 25 and the roller 26 and the pair of the roller 41 and the roller 42, and is discharged onto the tray 51 (Y in S11-6). At this time, after a predetermined time after detection of the trailing edge of the sheet 4 with the sensor 44, the end guide plate 80 is moved from the reference position R to the stapling position P with rotation of the motor 82 to push the sheet 4 against the stopper 71 and then returns to the reference position R (S11-8). The side guide plates 83 also move from the reference positions S to the T positions with rotation of the motor 92 to align the side edges of the sheet 4 and then return to the reference positions S (S11-7). If the sheet 4 has not been discharged onto the tray 51 in a predetermined time, i.e., if the trailing edge of the sheet 4 has not been detected with the sensor 44 in a predetermined time after the leading edge thereof has been detected (N in S11-6), the control device determines as that some trouble such as sheet jamming has occurred.

When the second sheet 4 is conveyed from the printer 2, similarly, a predetermined time after the sensor has detected the trailing edge of the second sheet 4, the end guide plate 80 and the side guide plates 83 align the second sheet 4, and return to the reference position R and the reference positions S, respectively. When the last sheet 4 of the stack of sheets 4 to be bound is conveyed from the printer 2 and is aligned as above (Y in S11-9), according to an instruction of the control device, the side guide plates 83 and the end guide plate 80 move to and stop at the binding positions, i.e., at the T positions and the P position, respectively (S11-12), and the stapler 75 staples the stack of sheets 4 (S11-13). After stapling, the stapler 75 returns to the standby status (Y in S11-14), the side guide plate 83 move from the T position about 1 mm in the direction indicated by the arrow Y in FIG. 5 so that the stack of sheets 4 can be easily moved (S11-15), and the end guide plate 80 moves from the P position to the Q position (S11-16). After a predetermined time, the solenoid 74 is operated and the stopper 71 moves from the J position to the K position, there by the stapled stack of sheets 4 is pushed out of the opening part of the stapler 75, so that the rear end of the stapled stack of sheets 4 is located at the Q position, and the stopper 71 is returned to the J position (S11-17).

Thereafter, the motor 62 starts to rotate and the tray 51 starts to move from the M position to the N position illustrated by the dashed line in FIG. 4 (S11-18). When the motor 62 starts to rotate, the motor 67 also starts to rotate and the discharging roller 63 rotates in the direction indicated by the arrow in FIG. 4 (S11-19). Further, the end guide plate 80 is moved from the Q position to the P position (S11-20) and pushes the stack of sheets 4 toward the discharging outlet 10. Finally, the tray 51 is moved to the N position, the stack of sheets 4 is sandwiched by the discharging roller 63 and the upper plates 69 of the side guide plates 83, and the stack of sheets 4 is discharged to the discharging outlet 10 with rotation of the discharging roller 63. The sensor 68 detects the trailing edge of the stack of sheets 4 (Y in S11-21), and then the end guide plate 80 returns from the P position to the reference position R and the side guide plates 83 return to the reference positions S (S11-22). Thereafter, the motor 62 starts to rotate and the tray 51 is returned from the N position to the M position (Sl1-23). The sensor 53 detects the tray 51 at the M position and the motor 62 stops (Y in S11-24), so that the tray 51 is positioned with the upper stopper 54, and thereby the binding operation ends.

If the stapler 75 has not returned to the standby status in a predetermined time after stapling (N in S11-14), the operation returns to step S11-13. If the stapler 75 has not returned to the standby status again, the control device determines as that some trouble has occurred. Also, if the stack of sheets 4 has not been discharged to the discharging outlet 10 with rotation of the discharging roller 63, i.e., if the sensor 68 has not detected the trailing edge of the stack of sheets 4 in a predetermined time (N in step S11-21), the operation returns to step S11-19, and if the sensor 68 has not detected the trailing edge of the stack of sheets 4 again, the control device determines as that some trouble such as sheet jamming has occurred. Further, if the tray 51 has not returned to the M position after discharging the stapled stack of sheets 4, i.e., if the tray 51 has not been detected with the sensor 53 in a predetermined time after rotating the motor 62 (N in step S11-24) the operation returns to step S11-23, and if the tray 51 has not been detected again, the control device determines as that some trouble has occurred. When the control device has determined as that some trouble has occurred as above, the control device causes an alert sound to be generated and at the same time causes an error message to be displayed in a display part (not illustrated) of the sheet processing apparatus 3.

When binding a series of stacks of sheets 4, next sheets 4 to be bound are conveyed from the printer 2 in succession. If the first sheet 4 of the next sheets 4 is received from the printer 2 when a binding operation is being performed at the binding part 8 as described below, in step S11-3, it is determined as that the binding operation is being performed at the binding part 8 (Y in step S11-3). Specifically, when the operations of steps S11-12 through S11-24 are being performed, i.e., after the side guide plates 83 and the end guide plate 80 have moved to and stopped at the binding positions, i.e., at the T positions and the P position, respectively, until returning of the tray 51 to the M position, the control device determines as that the binding operation is being performed. When the sensor 53 detects the tray 51 returned to the M position (Y in step S11-24), the control device determines as that the binding operation has been completed (N in step S11-3).

When it is determined in step S11-3 as that the binding operation is being performed (Y in step S11-3), while the roller 25 and the roller 26 rotate at the circumferential speed V, the roller 41 and the roller 42 rotate at the circumferential speed of one twentieth of the speed V of the roller 25 and the roller 26. Accordingly, a sheet 4 conveyed by the roller 25 and the roller 26 and pinched by the roller 45 and the roller 46 slacks and the slack of the sheet 4 gradually increases.

When the leading edge of the sheet 4 has been pinched between the roller 41 and the roller 42, the motor 35 starts to rotate, and the moving guide plate 23 rotates by a predetermined angle to move from, the G position to the H position so that the open area 13 is formed as illustrated in FIG. 3. Because the sheet 4 being conveyed by the roller 25 and the roller 26 is pinched between the roller 41 and the roller 42 at the leading edge thereof and is guided by the upper guide plate 21 at the upper surface thereof, the sheet 4 downwardly bulges toward the open area 13. When the trailing edge of the sheet 4 is finally released from the roller 25 and the roller 26, the trailing edge of the sheet 4 is discharged into the open area 13 and retreats from a conveying path between the roller 25 and the roller 26 as the first roller pair and the roller 41 and the roller 42 as the second roller pair to the open area 13. Thereafter, the motor 35 rotates and the moving guide plate 23 is returned to the reference position G and waits for the next sheet 4.

The next sheet 4 is conveyed while sliding over the previously conveyed sheet 4, and the leading edge thereof is pinched between the roller 41 and the roller 42 at the position shifted by a distance "d" from the leading edge of the previously conveyed sheet 4. The previously conveyed sheet 4 and the next sheet 4 are both pinched between the roller 41 and the roller 42 with the leading edge of the next sheet 4 shifted from that of the previously conveyed sheet 4 and wait for the following sheet 4 to be conveyed while being conveyed by the roller 41 and the roller 42.

The distance d may be sufficient if it is greater than about 5 mm. For example, if the circumferential speed of the roller 41 and the roller 42 is decreased to one half of that of the roller 25 and the roller 26, when a sheet 4 received by the roller 41 and the roller 42 is conveyed by about one half of a length of the sheet 4 with the roller 41 and the roller 42, the next sheet 4 reaches the roller 41 and the roller 42. In this case, disregarding a distance between sheets 4, two sheets 4 can be pinched between the roller 41 and the roller 42 to be held. That is, two sheets 4 can be held by the roller 41 and the roller 42 as the second roller pair and wait for the binding operation at the binding part 8 to be completed. If the circumferential speed of the roller 41 and the roller 42 is decreased to one twentieth of that of the roller 25 and the roller 26, about twenty sheets 4 can be pinched between the roller 41 and the roller 42 to be held. That is, twenty sheets 4 can be held by the roller 41 and the roller 42 as the second roller pair and wait for the binding operation at the binding part 8 to be completed.

Alternatively, the roller 41 and the roller 42 may be stopped after conveying a received sheet 4 by the distance d to wait for the next sheet 4 to arrive, i.e., after the roller 25 and the roller 26 have conveyed the sheet 4 at the circumferential speed V by a distance between a nip point of the roller 25 and the roller 26 and that of the roller 41 and the roller 42 added by the shifted distance d. More specifically, the sensor 24 detects the sheet 4, the roller 25 and the roller 26 conveys the sheet 4 at the circumferential speed V, the roller 41 and the roller 42 start to rotate at the timing the sheet 4 reaches the roller 41 and the roller 42, the roller 41 and the roller 42 convey the sheet 4 by the distance d, and then the roller 41 and the roller 42 stop. In this case, the circumferential speed of the roller 41 and the roller 42 can be the same as that of the roller 25 and the roller 26, but it is preferable that the circumferential speed of the roller 41 and the roller 42 is slower from the viewpoint of the stability.

The stack of sheets 4 on the tray 51 is stapled, the stapled stack of sheets 4 is discharged to the discharging outlet 10, and a predetermined time after the tray 51 has returned to the M position, the control device determines as that the binding operation has been completed (Y in step S11-3). Then, the roller 41 and the roller 42 are rotated by the motor 49 at the same circumferential speed as that of the roller 25 and the roller 26, and a plurality of sheets 4 pinched between the roller 41 and the roller 42 with leading edges thereof shifted stepwise are discharged onto the tray 51 by the roller 41 and the roller 42.

The sheets 4 discharged onto the tray 51 are aligned at the binding position by the side guide plates 83 and the end guide plate 80, and wait for subsequent sheets 4 to be conveyed. Subsequent sheets 4 received from the printer 2 one after another are conveyed by the roller 25 and the roller 26 as the first roller pair and the roller 41 and the roller 42 as the second roller pair at the circumferential speed V, discharged onto the tray 51 one after another, and are aligned at the binding position. A predetermined time after the trailing edge of the last sheet 4 of a group of sheets 4 to be bound has been detected with the sensor 44, the binding operation starts. On the other hand, a next group of sheets 4 to be bound, that are received from the printer 2 one after another, are caused to wait at the sheet waiting part 6 in the same manner as described above. Thus, the printer 2 can successively form images on sheets 4 and does not need to stop forming images on sheets 4 to wait for the binding operation at the sheet processing apparatus 3 to be completed.

Figure 7:
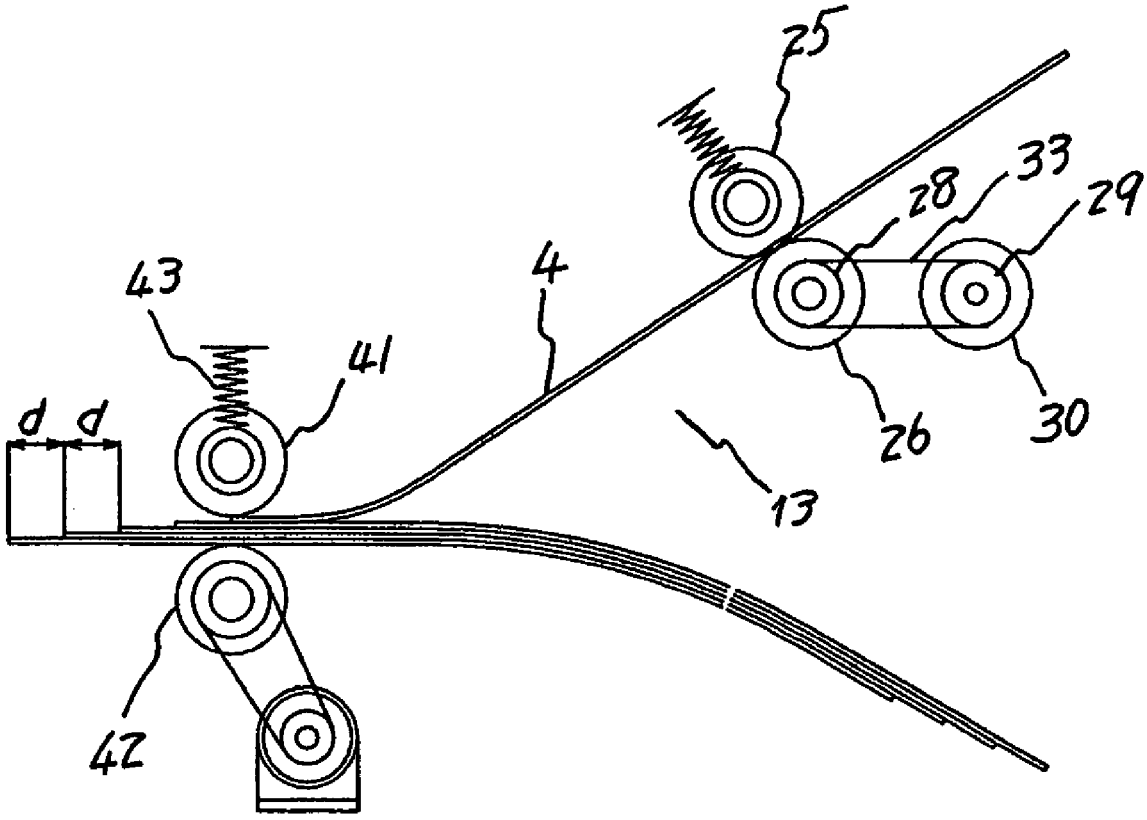
FIG. 7 is diagram illustrating a state that sheets are held at the sheet waiting part.

FIG. 7 illustrates a state that sheets 4 are held at the sheet waiting part 6 to be further conveyed. As illustrated, the sheets 4 are pinched between the roller 41 and the roller 42 with leading edges thereof shifted stepwise one after another by the distance d. After the binding operation is completed, the sheets 4 pinched between the roller 41 and the roller 42 are conveyed by the roller 41 and the roller 42 at the circumferential speed V which is the same as that of the roller 25 and the roller 26 to be discharged onto the tray 51.

Figure 8:
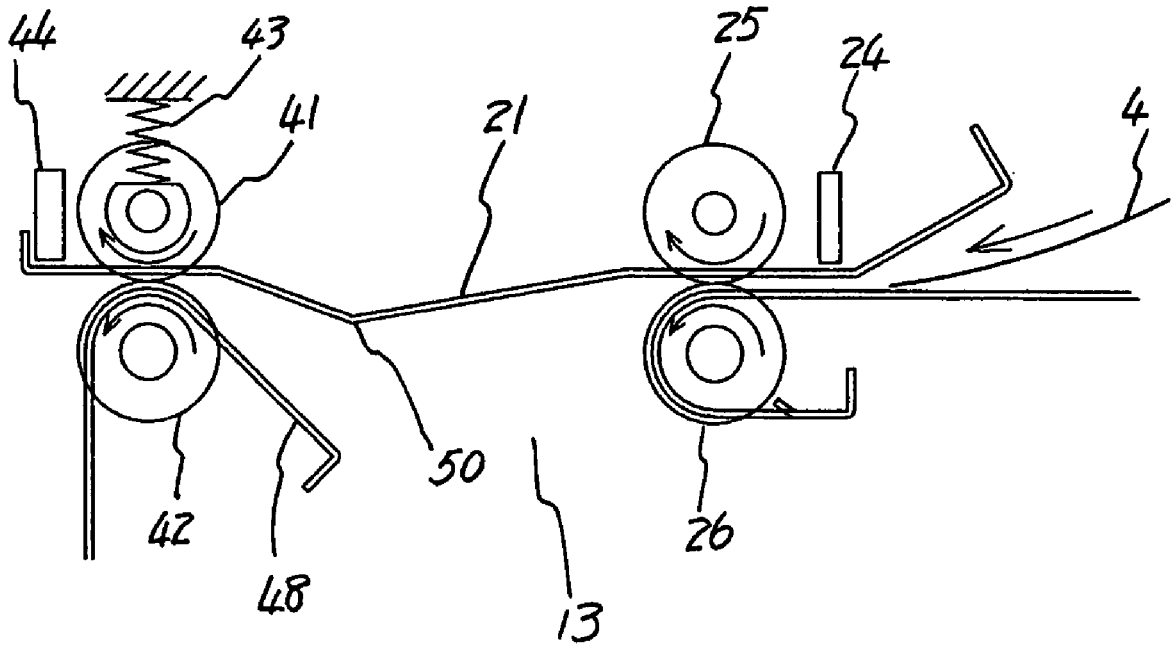
FIG. 8 is a cross section illustrating another exemplary construction of the sheet waiting part.

FIG. 8 illustrates another example of the sheet waiting part 6 of the sheet processing apparatus 3, in which the moving guide plate 23 is not used. As illustrated in figure, a protrusion part 50 is formed in the upper guide plate 21, so that when a sheet 4 is conveyed by the roller 25 and the roller 26, the sheet 4 is directed slightly downward by the protrusion part 50. The sheet 4 then reaches the cover 48 and is guided to be pinched between the roller 41 and the roller 42 rotating at the speed decreased to one twentieth of the circumferential speed V of the roller 25 and the roller 26. Because the trailing edge part of the sheet 4 is conveyed by the roller 25 and the roller 26 at the circumferential speed V, the sheet 4 is caused to bulge, and the bulge thereof is directed toward the open area 13 by the protrusion part 50, and finally the trailing edge part of the sheet 4 is discharged into the open area 13. A subsequent sheet 4 is conveyed while sliding over the previously conveyed sheet 4 to be pinched between the roller 41 and the roller 42. The protrusion part 50 may be formed for example at the part of the upper guide-plate 21 about 50 mm downstream of the nip part of the roller 25 and the roller 26, downwardly protruding about 5 mm from a straight line connecting the nip part of the roller 25 and the roller 26 and that of the roller 41 and the roller 42. The cover 48 may be formed about 50 mm in length and be angled at about 30 through 45 degrees relative to the above straight line.

Figure 9:
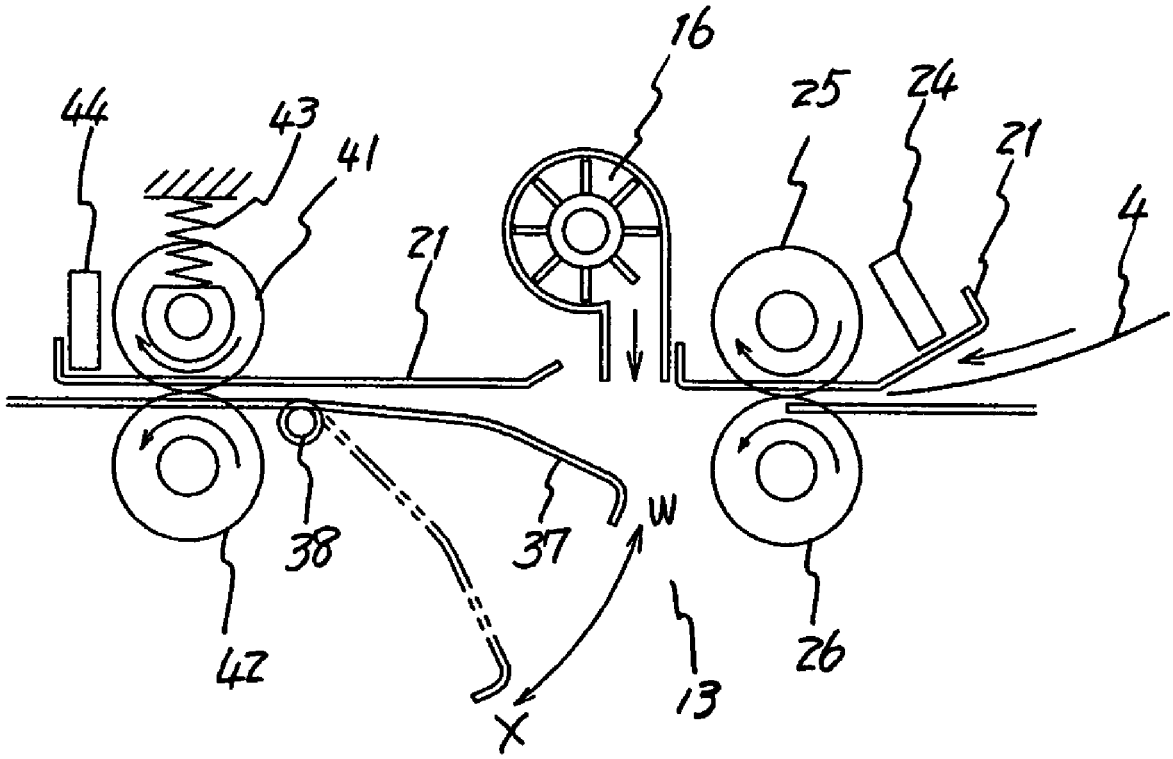
FIG. 9 is a cross section illustrating still another exemplary construction of the sheet waiting part.

FIG. 9 illustrates another example of the sheet waiting part 6 of the sheet processing apparatus 3, in which the protrusion part 50 is not provided to the upper guide plate 21, and instead a fan 16 serving as a device for causing the sheet 4 to bulge toward the open area 13 is arranged above the upper guide plate 21, i.e., at the opposite side of the open area 13. When the sheet 4 has been pinched between the roller 41 and the roller 42 at the leading edge thereof, the fan 16 blows the air in the arrow direction in figure, so that the sheet 4 bulges toward the open area 13. Further, a rotating guide plate 37 is arranged to stably guide the sheet 4 to be pinched between the roller 41 and the roller 42. The rotating guide plate 37 is positioned at a "W" position when guiding the sheet 4 to be pinched between the roller 41 and the roller 42 and is positioned at an "X" position when discharging the trailing edge of the sheet 4 into the open area 13.

Figure 10:
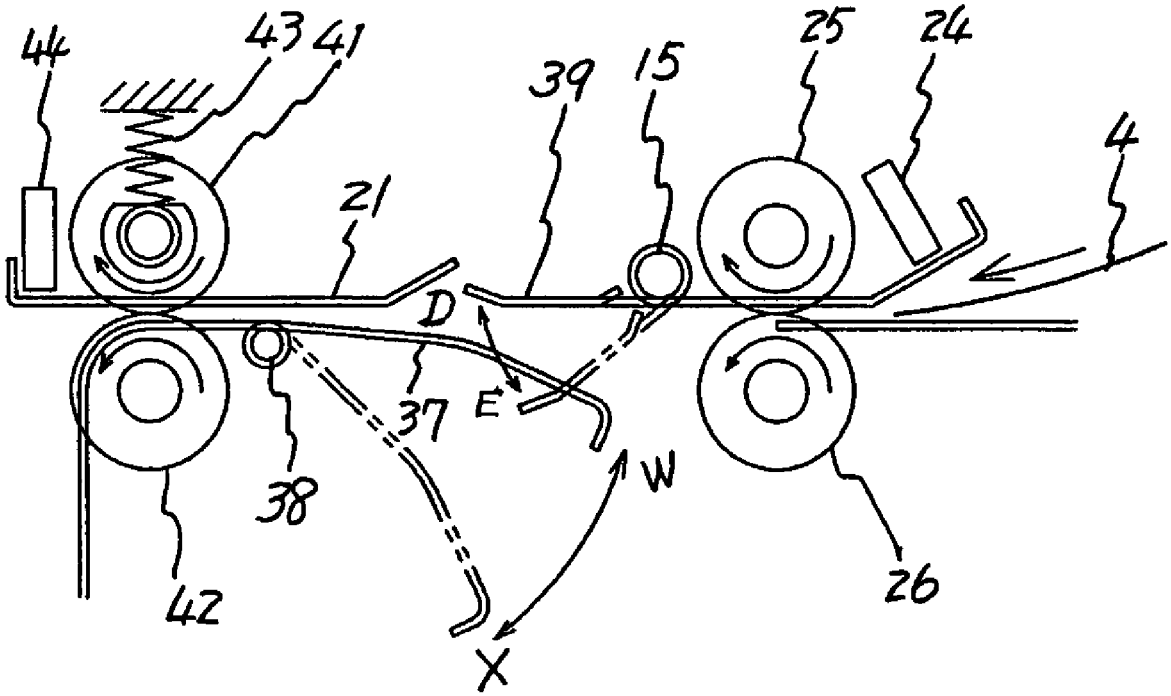
FIG. 10 is a cross section illustrating still another exemplary construction of the sheet waiting part.

FIG. 10 illustrates another example of the sheet waiting part 6 of the sheet processing apparatus 3, in which a sheet pushing plate 39 as a device to bulge the sheet 4 toward the open area 13 is provided to the upper guide plate 21. Further, the rotating guide plate 37 is provided to surely guide the sheet 4 to be pinched between the roller 41 and the roller 42. When the roller 25, the roller 25, the roller 41 and the roller 42 rotate at the circumferential speed V, i.e., when the binding operation is not being performed at the binding part 8 of the apparatus 3, the sheet pushing plate 39 is positioned at a "D" position and the rotating guide plate 37 is positioned at the W position.

When a sheet 4 is received from the printer 2 while the binding operation is being performed at the binding part 8, the sensor detects the sheet 4, the roller 25 and the roller 26 rotate at the circumferential speed V, the roller 41 and the roller 42 rotate at a decreased circumferential speed, and at the same time when the sheet 4 is pinched between the roller 41 and the roller 42 at the leading edge thereof, the rotating guide plate 37 is rotated by a solenoid (not illustrated) from the W position to the X position around an axis 38 and the sheet pushing plate 39 is also rotated by a solenoid (not illustrated) from the D position to an "E" position around an axis 15. Thereby, the bulge of the sheet 4 pinched between the roller 41 and the roller 42 at the leading edge thereof is directed toward the open area 13, and finally the trailing edge of the sheet 4 is discharged into the open area 13. A predetermined time thereafter, the rotating guide plate 37 returns to the W position and the sheet pushing plate 39 returns to the D position to wait for the next sheet 4.

Figure 11:
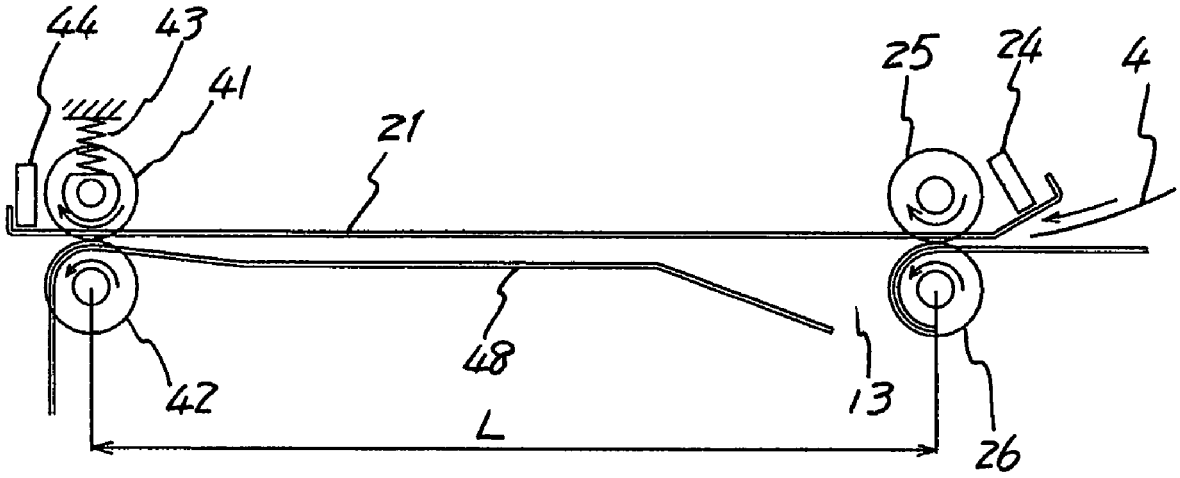
FIG. 11 is a cross section illustrating still another exemplary construction of the sheet waiting part.

FIG. 11 illustrates another example of the sheet waiting part 6 of the sheet processing apparatus 3, in which neither a bulging device nor a rotating guide plate is used. In this example, a distance "L" between the nip of the roller 25 and the roller 26 as the first roller pair and that of the roller 41 and the roller 42 as the second roller pair is set at a length smaller than a length (in the direction in which sheets 4 are conveyed) of sheets 4 to be processed by the sheet processing apparatus 3, and a guide plate 48 is arranged separated from the upper guide plate 21 about 7-8 mm to guide a sheet 4 to be pinched between the roller 41 and the roller 42 and such that the open area 13 is formed below the upper guide plate 21 near the roller 25 and the roller 26. The guide plate 48 is downwardly bent at a part thereof at the side of the roller 25 and the roller 26 so that the sheet 4 is guided to be pinched between the roller 41 and the roller 42 and the trailing edge part of the sheet 4 retreats from a conveying path between the roller 25 and the roller 26 as the first roller pair and the roller 41 and the roller 42 as the second roller pair toward the open area 13 and thereby the next sheet 4 is conveyed while sliding over the previously conveyed sheet 4. When the maximum size of sheets 4 processed by the sheet processing apparatus 3 is A4 for example, the length L is set about 10-20 mm shorter than the longitudinal length of A4, and the guide plate 48 is downwardly bent at a part thereof about 80 mm downstream side of the nip of the roller 25 and the roller 26 at the angle of about 30 degrees.

Numerous additional modifications and variations of the present invention are possible in light of the above teachings. It is therefore to be understood that within the scope of the appended claims, the present invention can be practiced otherwise than as specifically described herein.

What is claimed is:

1. A sheet processing apparatus, comprising:

a first roller pair rotatably held and driven for conveying a sheet received from an external apparatus;

a second roller pair rotatably held and driven for conveying the sheet conveyed from the first roller pair;

a guide channel between the first roller pair and the second roller pair through which each sheet passes, the guide channel formed by an upper guide plate and forming an open area below the upper guide plate;

a jogging tray on which sheets conveyed from the second roller pair via the guide channel are stacked and jogged;

a binding device for binding a stack of sheets received and jogged by the jogging tray; and a controller for controlling the second roller pair so that during a standby operation, leading edge ends of sheets received from the external apparatus and conveyed by the first roller pair one after another via the guide channel are pinched by the second roller pair while being overlapped and stacked one upon another with leading edges thereof shifted stepwise one after another and so that trailing edge ends of the stacked sheets are discharged into the open area while the stacked sheets are held by the second roller pair to be further conveyed by the second roller pair to the jogging tray, wherein the guide channel between the first roller pair and the second roller pair through which each sheet passes is formed by the upper guide plate and a lower pivotally movable guide plate, the lower pivotally movable guide plate capable of pivoting between a first position adjacent the upper guide plate to form the guide channel and a second position not adjacent the upper guide plate to form an open area below the upper guide plate and wherein the controller controls the second roller pair and the pivotally movable guide plate so that during a standby operation, leading edge ends of sheets received from the external apparatus and conveyed by the first roller pair one after another via the guide channel are pinched by the second roller pair while being overlapped and stacked one upon another with leading edges thereof shifted stepwise one after another and moves the pivotally movable guide plate to the second position not adjacent the upper guide plate to form the open area below the upper guide plate so that trailing edge ends of the stacked sheets are discharged into the open area while the stacked sheets are held by the second roller pair to be further conveyed by the second roller pair to the jogging tray.

2. The sheet processing apparatus according to claim 1 wherein the controller controls the second roller pair so that the second roller pair is driven to intermittently rotate.

3. The sheet processing apparatus according to claim 1, wherein the controller controls the second roller pair so that the second roller pair is driven to rotate at a speed slower than a speed of the first roller pair.

4. The sheet processing apparatus according to claim 1, further comprising a device configured to cause the trailing edge end of each of the sheets conveyed by the first roller pair one after another to retreat from the conveying path to the open area after the sheet has been pinched by the second roller pair.

5. The sheet processing apparatus according to claim 1, wherein during a normal operation, the controller controls the second roller pair to rotate at a speed substantially the same as a speed of the first roller pair and moves the pivotally movable guide plate to the first position adjacent the upper guide plate so that the sheets are conveyed by the first roller pair to the second roller pair via the guide channel and from the second roller pair to the jogging tray one after another without overlapping edges.

6. The sheet processing apparatus according to claim 1, further comprising:

a discharging device discharging the stack of sheets bound by the binding device from the jogging tray, and wherein the standby operation occurs when the stack of sheets bound by the binding device has not been discharged from the jogging tray by the discharging device in a predetermined period of time or when the jogging tray has not returned to a reference position in a predetermined period of time.

7. The sheet processing apparatus according to claim 1, wherein the first roller pair conveys the sheet from the external apparatus which comprises an image forming apparatus.

8. A method of operating a sheet processing system, comprising:

providing a sheet processing system comprising, a first roller pair rotatably held and driven for conveying a sheet received from an external apparatus, a second roller pair rotatably held and driven for conveying the sheet conveyed from the first roller pair, a guide channel between the first roller pair and the second roller pair through which each sheet passes, the guide channel formed by an upper guide plate and forming an open area below the upper guide plate;

a jogging tray on which sheets conveyed from the second roller pair via the guide channel are stacked and jogged;

a binding device for binding a stack of sheets received and jogged by the jogging tray; and a controller for controlling the second roller pair so that during a standby operation, leading edge ends of sheets received from the external apparatus and conveyed by the first roller pair one after another via the guide channel are pinched by the second roller pair while being overlapped and stacked one upon another with leading edges thereof shifted stepwise one after another and so that trailing edge ends of the stacked sheets are discharged into the open area while the stacked sheets are held by the second roller pair to be further conveyed by the second roller pair to the jogging tray, wherein the guide channel between the first roller pair and the second roller pair through which each sheet passes is formed by the upper guide plate and a lower pivotally movable guide plate, the lower pivotally movable guide plate capable of pivoting between a first position adjacent the upper guide Plate to form the guide channel and a second position not adjacent the upper guide plate to form an open area below the upper guide plate and wherein the controller controls the second roller pair and the Pivotally movable guide plate so that during a standby operation, leading edge ends of sheets received from the external apparatus and conveyed by the first roller pair one after another via the guide channel are pinched by the second roller pair while being overlapped and stacked one upon another with leading edges thereof shifted stepwise one after another and moves the Pivotally movable guide plate to the second position not adjacent the upper guide plate to form the open area below the upper guide plate so that trailing edge ends of the stacked sheets are discharged into the open area while the stacked sheets are held by the second roller pair to be further conveyed by the second roller pair to the jogging tray.

9. A sheet processing apparatus, comprising:

first roller means for conveying a sheet received from an external apparatus;

second roller means for conveying the sheet conveyed from the first roller pair;

guide channel means between the first roller means and the second roller means through which each sheet passes, the guide channel means formed by an upper guide plate means and forming an open area below the upper guide plate means;

jogging means on which sheets conveyed from the second roller means via the guide channel means are stacked and jogged;

binding means for binding a stack of sheets received and jogged by the jogging means; and controller means for controlling the second roller means so that during a standby operation, leading edge ends of sheets received from the external apparatus and conveyed by the first roller means one after another via the guide channel means are pinched by the second roller means while being overlapped and stacked one upon another with leading edges thereof shifted stepwise one after another and so that trailing edge ends of the stacked sheets are discharged into the open area while the stacked sheets are held by the second roller means to be further conveyed by the second roller pair to the jogging means, wherein the guide channel means between the first roller means and the second roller means through which each sheet passes is formed by the upper guide plate means and a lower pivotally movable guide plate means, the lower pivotally movable guide plate means capable of pivoting between a first position adjacent the upper guide plate means to form the guide channel means and a second position not adjacent the upper guide plate means to form an open area below the upper guide plate means and wherein the controller means controls the second roller means and the pivotally movable guide plate means so that during a standby operation, leading edge ends of sheets received from the external apparatus and conveyed by the first roller means one after another via the guide channel means are pinched by the second roller means while being overlapped and stacked one upon another with leading edges thereof shifted stepwise one after another and moves the pivotally movable guide plate means to the second position not adjacent the upper guide plate means to form the open area below the upper guide plate means so that trailing edge ends of the stacked sheets are discharged into the open area while the stacked sheets are held by the second roller means to be further conveyed by the second roller means to the jogging means.

* * * * *